US012559958B2

(12) United States Patent
Fried

(10) Patent No.: US 12,559,958 B2
(45) Date of Patent: Feb. 24, 2026

(54) ANCHOR PLATE SYSTEM FOR REINFORCING MASONRY WALLS THAT ARE PERPENDICULAR TO SUPPORT JOISTS

(71) Applicant: Craft Pro Masonry Restorations, Inc., Hulmeville, PA (US)

(72) Inventor: Michael Fried, Hulmeville, PA (US)

(73) Assignee: CRAFT PRO MASONRY RESTORATIONS, INC., Hulmeville, PA (US)

( * ) Notice: Subject to any disclaimer, the term of this patent is extended or adjusted under 35 U.S.C. 154(b) by 262 days.

(21) Appl. No.: 18/349,625

(22) Filed: Jul. 10, 2023

(65) Prior Publication Data

US 2023/0349182 A1 Nov. 2, 2023

Related U.S. Application Data

(63) Continuation-in-part of application No. 17/378,682, filed on Jul. 17, 2021, now abandoned, which is a continuation-in-part of application No. 16/920,624, filed on Jul. 3, 2020, now Pat. No. 11,421,433.

(51) Int. Cl.

| | |
|---|---|
| ***E06B 3/00*** | (2006.01) |
| ***E04B 1/35*** | (2006.01) |
| ***E04G 23/02*** | (2006.01) |

(52) U.S. Cl.

CPC ..... *E04G 23/0218* (2013.01); *E04B 1/35* (2013.01); *E04B 2001/3583* (2013.01)

(58) Field of Classification Search

CPC ..... E04B 2001/3583; E04B 1/4178; F16B 35/005; F16B 5/065; E04C 2003/026; E04G 23/0222

See application file for complete search history.

(56) References Cited

U.S. PATENT DOCUMENTS

| | | | | |
|---|---|---|---|---|
| 318,648 | A * | 5/1885 | Paradise | E04C 3/18 52/703 |
| 484,666 | A * | 10/1892 | Mitchell | E04C 3/18 52/703 |
| 752,930 | A | 2/1904 | Silver | |
| 893,676 | A | 7/1908 | Tschantz | |
| 1,053,231 | A | 2/1913 | Schweikert | |
| 1,176,903 | A | 3/1916 | Johnston | |
| 1,684,187 | A | 9/1928 | Loening | |

(Continued)

*Primary Examiner* — Basil S Katcheves

(74) *Attorney, Agent, or Firm* — LaMorte & Associates P.C.

(57) ABSTRACT

A system and method of retroactively reinforcing a wall of a building. An anchoring assembly is mounted into the void space between a first joist and a second joist inside the building. The anchoring assembly has two brackets that mount to the first joist and a second element on the opposite side of the same void space. A beam is attached to both the first bracket and the second bracket within the confines of the void space. An anchor plate is placed against the wall that needs reinforcement. A tensioning tether is provided that can be affixed to the anchor plate. The tensioning tether extends through both the wall and the beam. The tensioning tether can be selectively tightened to pull the anchoring plate against the wall and toward the beam. The tensioning tether inhibits the wall from moving away from the joists, therein stabilizing the wall.

9 Claims, 4 Drawing Sheets

(56) References Cited

U.S. PATENT DOCUMENTS 1,982,088 A 11/1934 White
2,713,983 A * 7/1955 Kay ..... H02G 3/125 248/200.1
2,914,816 A * 12/1959 Lundgren ..... E04C 3/02 52/645
3,353,312 A 11/1967 Storch
4,021,990 A 5/1977 Schwalberg
4,125,978 A * 11/1978 Schildge, Jr. ..... E04H 9/021 52/73
4,374,580 A * 2/1983 Minor ..... E04C 3/02 248/231.21
4,472,916 A * 9/1984 Krebs ..... E04B 1/18 52/762
4,596,102 A 6/1986 Catani
4,606,163 A * 8/1986 Catani ..... E04B 1/4178 52/713
4,773,794 A 9/1988 Harke
4,790,114 A 12/1988 Falco
4,930,284 A 6/1990 Falco
5,644,889 A 7/1997 Getz
6,141,932 A * 11/2000 Tarrant ..... E04D 3/30 52/409
7,380,372 B2 * 6/2008 Resch ..... E04G 23/0218 52/150
7,404,274 B2 7/2008 Hayes
7,665,271 B2 * 2/2010 Kawai ..... E04B 1/2403 52/703
7,861,469 B2 * 1/2011 Heady ..... E02D 37/00 52/150
8,136,317 B1 * 3/2012 McCown ..... E04G 23/0229 52/514
8,555,587 B2 10/2013 Hohmann, Jr.
2009/0158678 A1 6/2009 Ginter et al.
2013/0031771 A1 * 2/2013 Henneberry ..... F16B 13/0808 411/402
2019/0048577 A1 * 2/2019 Studer ..... E04B 1/003
2019/0376278 A1 * 12/2019 Espinosa ..... E04B 2/56
2024/0309633 A1 * 9/2024 Fried ..... F16B 5/065

* cited by examiner

ANCHOR PLATE SYSTEM FOR REINFORCING MASONRY WALLS THAT ARE PERPENDICULAR TO SUPPORT JOISTS

RELATED APPLICATIONS

This application is a continuation-in-part of U.S. patent application Ser. No. 17/378,682 filed Jul. 17, 2021, which is a continuation-in-part of U.S. patent application Ser. No. 16/920,624 filed Jul. 3, 2020, now U.S. Pat. No. 11,421,433.

BACKGROUND OF THE INVENTION

1. Field of the Invention

In general, the present invention relates to anchor plates and the methodology used when installing anchor plates. More particularly, the present invention relates to the structure of the anchor plate, the structure of the anchor that retains the anchor plate, and the methodology of installing anchor plates and anchors in preexisting walls that are in need of reinforcement.

2. Prior Art Description

Many buildings contain masonry walls that are made of brick, block, or stone. The masonry may form the structure of a wall or may just be a façade in front of a traditional lumber wall. Regardless, due to a variety of reasons, such as ground settlement, load shifting, water damage and the like, masonry walls can develop warps and buckles over time. Once a warp or buckle begins, it tends to increase in severity over time until the wall loses its structural integrity.

Recognizing that warps occur in many masonry walls, anchor plates are often added to masonry walls. Variations in anchor plate reinforcement have been in use for hundreds of years. Anchor plates are metal plates that are bolted to the lumber framework of a building through a hole in the masonry wall. The anchor plate is an enlarged plate that presses against the exterior of the masonry wall, therein preventing the masonry wall from buckling outwardly. Since the anchor plate is visible on the exterior of the wall, the anchor plate is traditionally given a decorative shape, such as a star. As such, anchor plates are also commonly referred to as star plates.

Anchor plates are held in place by a tensioning tether. The tensioning tether can be a bolt, cable, or rod that extends through a hole in the masonry wall and engages the lumber framework of the building. Within the building, tensioning tethers are commonly anchored to multiple floor joists. This provides the anchor strength needed to resist the pulling force of a buckled wall. When anchoring a tether to a joist, the operation is fairly simple if the incoming tensioning tether is perpendicular to the floor joists. If the tether and floor joist are perpendicular, the tether can pass through a hole in the joist and be anchored with a washer and nut or similar anchor structure. If the tensioning tether enters a building at an orientation that is parallel to the joists, then anchoring is far more difficult. This is especially true if a tensioning tether enters a building parallel to a framing joist in a void between the framing joists.

When a slight warp or buckle is noticed in a masonry wall, it is desirable to install an anchor plate in order to stop the warp or buckle from progressing further. However, to retroactively install an anchor plate, a hole must be drilled into the masonry at a position that is either perpendicular to the floor joists or aligned with one of the floor joists. This typically limits the possible positions for the anchor plates. Walls predominantly buckle in the areas between joists. Accordingly, there is a good chance that an anchor plate cannot be installed in the section of the wall where it would add the most benefit.

A need therefore exists for an improved anchor plate system that can be retroactively added to masonry walls that enables masonry walls to be supported at positions that do not necessarily align with floor joists. This need is met by the present invention as described and claimed below.

SUMMARY OF THE INVENTION

The present invention is a system and method of retroactively reinforcing a wall of a building having floor joists. In accordance with the present invention, an anchoring assembly is provided that includes two identical brackets. A first bracket is mounted to a first joist in a void space between joists. A second bracket is mounted to a second joist on the opposite side of the same void space.

A beam is attached to both the first bracket and the second bracket within the confines of the void space. An anchor plate is placed against the wall that needs reinforcement. A tensioning tether is provided that can be affixed to the anchor plate. The tensioning tether extends through both the wall and the beam. The tensioning tether can be selectively tightened to pull the anchor plate against the wall and toward the beam. The tensioning tether inhibits the wall from moving away from the joists, therein stabilizing the wall.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention reinforcement system can be embodied in many ways, only two exemplary embodiments are illustrated. The exemplary embodiments are shown for the purposes of explanation and description. The exemplary embodiments are selected in order to set forth some of the best modes contemplated for the invention. The illustrated embodiments, however, are merely exemplary and should not be considered limitations when interpreting the scope of the appended claims.

Figure 1:
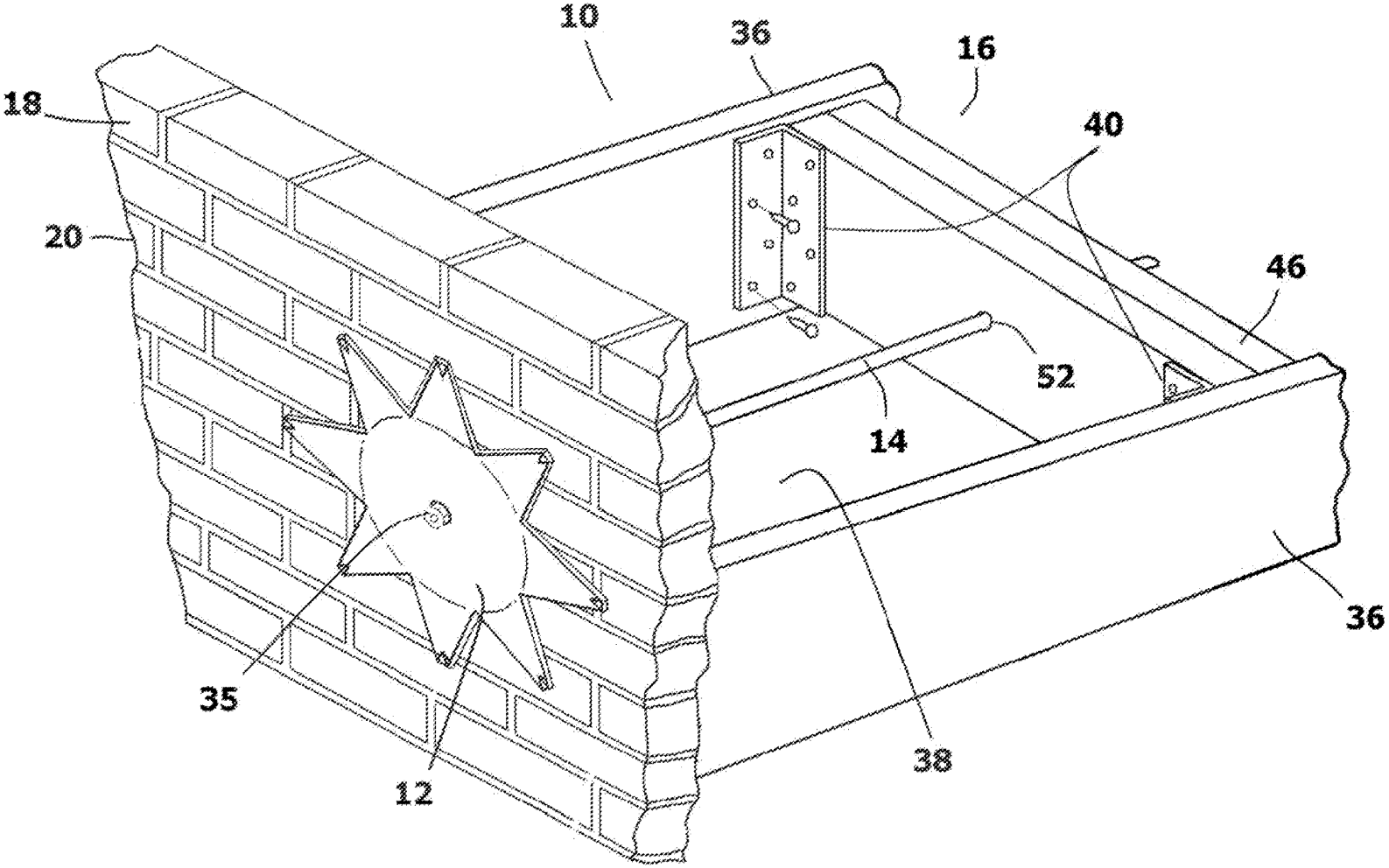
FIG. 1 is a fragmented view of a wall in a building in which an exemplary embodiment of the reinforcement system is installed with joists that are perpendicular to the exterior wall.
Figure 2:
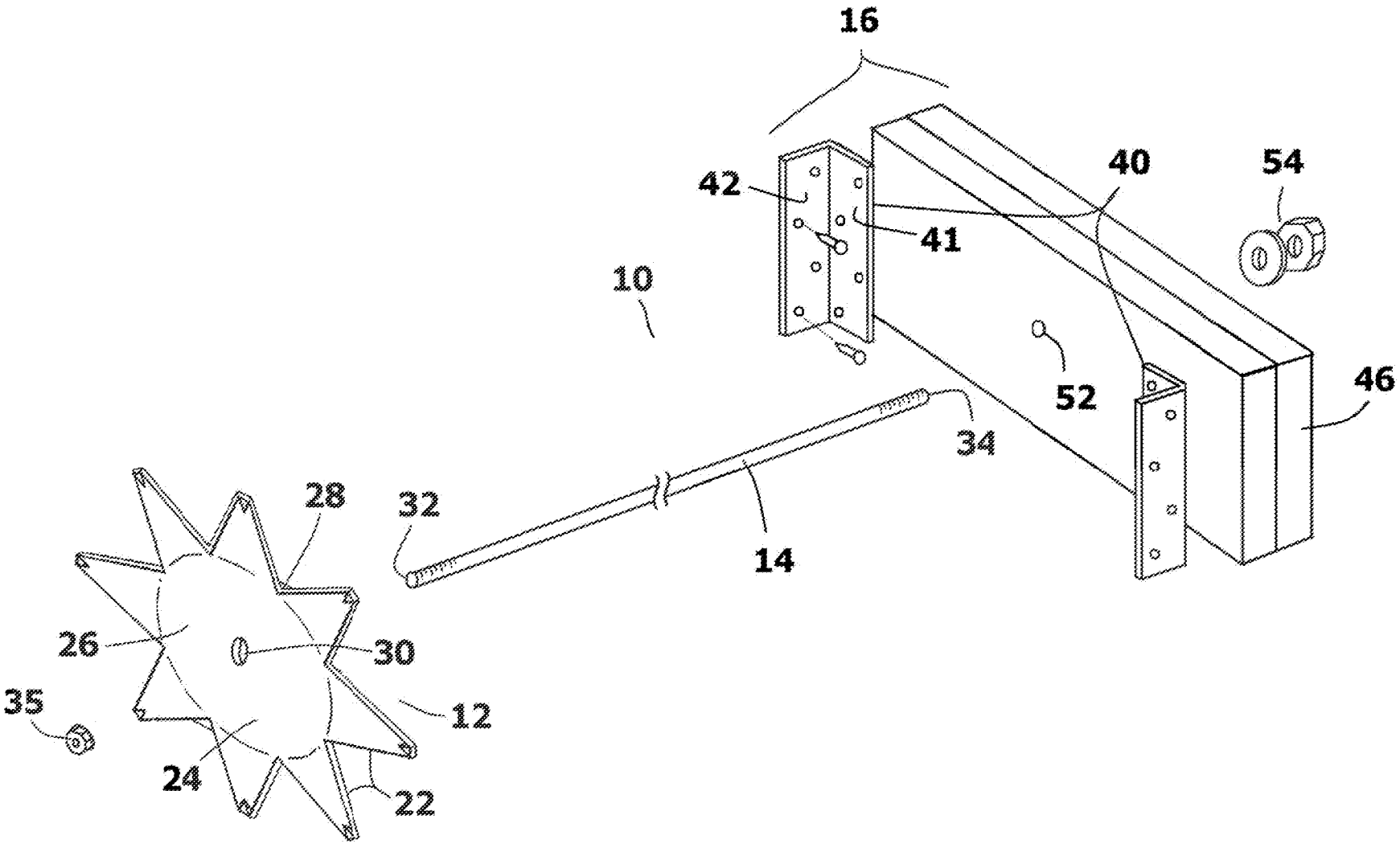
FIG. 2 is an exploded view of an exemplary embodiment of the reinforcement system utilized in FIG. 1.

Referring to FIG. 1 and FIG. 2, an improved reinforcement system 10 is shown. The reinforcement system 10 includes an anchor plate 12, a tensioning tether 14, and an anchoring assembly 16. As will be explained, the tensioning tether 14 and the anchoring assembly 16 are retroactively mounted within a building 20. The anchor plate 12 is attached to the tensioning tether 14 and is biased against a masonry wall 18 by the tensioning tether 14. This reinforces the masonry wall and prevents the masonry wall from further deflecting in the area of the anchor plate 12.

In the illustrated embodiment, the anchor plate 12 has a plurality of arms 22 that radially extend from a central hub 24. In the shown embodiment, the anchor plate 12 is star-shaped having eight arms 22. However, it should be understood that other shapes such as cross shapes and varying polygonal stars can also be used. The anchor plate 12 has a face surface 26 and an opposite contact surface 28. In use, the contact surface 28 abuts against the masonry wall 18. The anchor plate 12 can be made of a variety of materials, but is preferably made of stainless steel, galvanized steel, bronze, or some other high strength metal alloy that is resistant to rust and is capable of being exposed to the elements for decades.

A mounting hole 30 is formed in the geometric center of the anchor plate 12. This is a central connection point. The mounting hole 30 is used to interconnect the tensioning tether 14 to the anchor plate 12.

The tensioning tether 14 can be a helical masonry tie, steel bolt, rod, chain, or cable. The tensioning tether 14 has a first end 32, a second end 34 and a length between the ends 32, 34. The first end 32 of the tensioning tether 14 is configured to attach to the anchor plate 12 through the mounting hole 30 in the central hub 24 of the anchor plate 12. In the shown embodiment, the first end 32 of the tensioning tether 14 is threaded and is attached to the anchor plate 12 using a threaded nut 35. Alternatively, it will be understood that the tensioning tether 14 can be terminated with a bolt head, therein eliminating the need for the threaded nut 35. Alternative connections, such as welded connections, can also be used.

The second end 34 of the tensioning tether 14 is inserted into the structure of the building 20 through the masonry wall 18. The length of the tensioning tether 14 depends upon the features of the masonry wall 18 and the lumber framework within the building 20. In the shown embodiment, the framework within the building 20 includes joists 36. The joists 36 are oriented at a perpendicular to the masonry wall 18. The joists 36 are typically spaced either 16 inches or 24 inches apart. Accordingly, there are void spaces 38 between the joists 36. The anchoring assemblies 16 are set into the void spaces 38 between the joists 36.

The anchoring assembly 16 includes a set of two brackets 40. Each of the brackets 40 is made from a length of steel angle iron that has an L-shaped profile. The lengths of the brackets 40 are no greater than the height of each of the joists 36. If the joists 36 are ten inches high, the length of each of the brackets 40 is preferably between six inches and eight inches in length. If the joists 36 are twelve inches high, the length of each of the brackets 40 is preferably between eight inches and ten inches in length. Each of the brackets 40 has two legs 41, 42, which include the mounting leg 41 and the free leg 42. Bolt holes 44 are formed in both the mounting leg 41 and the free leg 42.

The brackets 40 are mounted to joists 36 on opposite sides of the same void space 38. The brackets 40 are mounted to the joists 36 at the same distances from the masonry wall 18. The mounting leg 41 of each bracket 40 is bolted to the joists 36 by extending a bolt 45 or similar connector through the bolt holes 44 and into the joists 36. The bolts 45 can be extended through the joists 36 and be set with washers and nuts. Alternatively, the bolts 45 can be lag bolts that terminate in the joists 36, as is illustrated.

Once the brackets 40 are joined to the joists 36, the free legs 42 of each of the brackets 40 extend into the void space 38 between the joists 36. The void space 38 has a width between the opposing joists 36. A length of beam 46 is provided. The length of beam 46 has a length that is equal to, or slightly smaller than, the width between the joints 36. The height of the length of beam 46 is no greater than the height of the joists 36. Accordingly, the length of beam 46 can fit within the void space 38. The length of beam 46 can be a length of a metal beam, such as an I-beam. However, the length of beam 46 is preferably made from one or more cut lengths of construction lumber or engineered lumber. If construction lumber is used, as is illustrated, it is preferred that the length of beam 46 be made from at least two cut lengths that are glued and/or nailed together.

The length of beam 46 is positioned to span the void space 38 between the joists 36. The length of beam 46 is then bolted to the free legs 42 of the brackets 40 so that the brackets 40 are between the length of beam 46 and the masonry wall 18.

Figure 3:
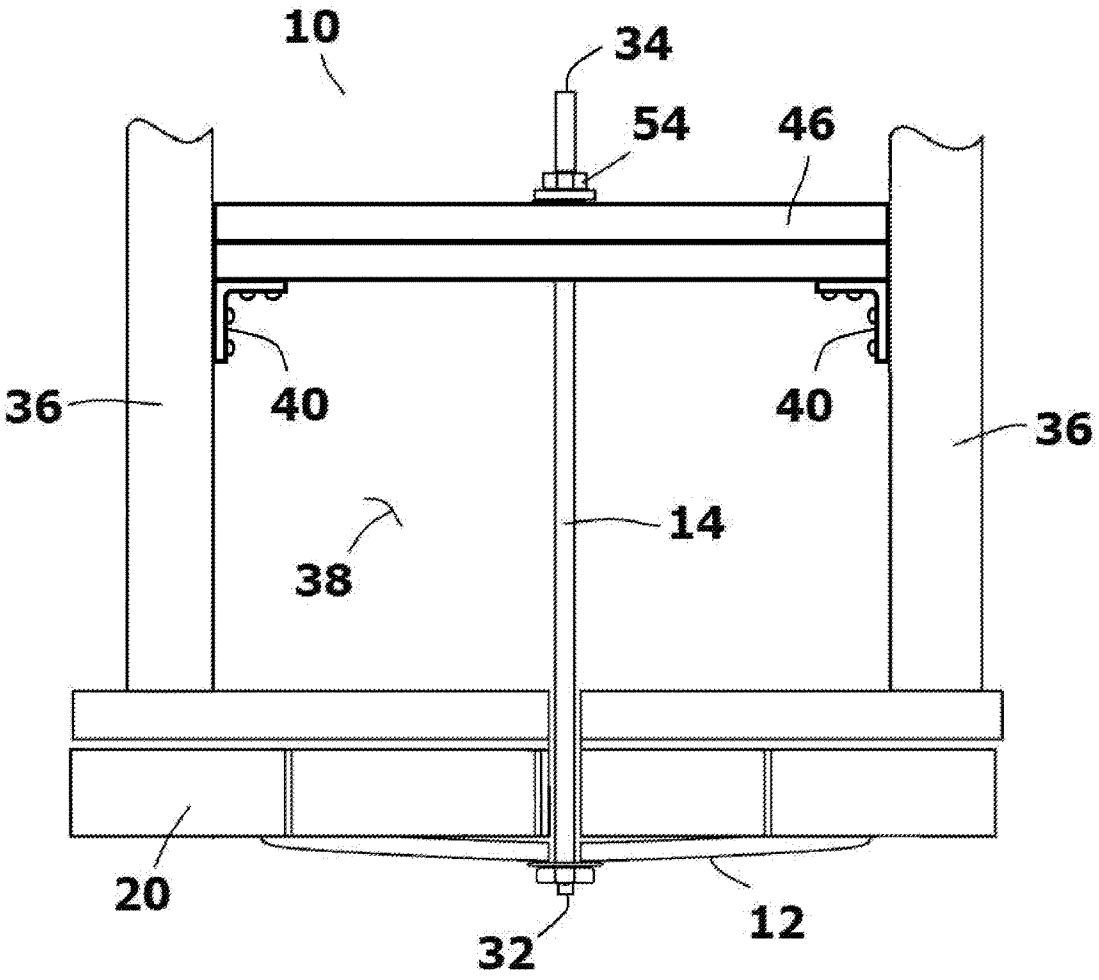
FIG. 3 is a top view of a wall in a building in which the exemplary embodiment of the reinforcement system is installed.

Referring to FIG. 3 in conjunction with FIG. 1 and FIG. 2, it will be understood that to install the reinforcement system 10, an access hole 52 is made in the masonry wall 18 to accommodate the tensioning tether 14. If the tensioning tether 14 is a rod, bolt or cable, the access hole 52 is drilled through the masonry wall 18. If the tensioning tether 14 is a helical tie or helical rod, the tensioning tether 14 can be directly driven through the masonry wall 18. Once installed, the tensioning tether 14 has its first end 32 outside the building 20 and its second end 34 in the void space 38 between the joists 36.

The first end 32 of the tensioning tether 14 is accessible on the outside of the masonry wall 18. The first end 32 of the tensioning tether 14 is advanced through the anchor plate 12. The tensioning tether 14 is terminated or otherwise prevented from being pulled through the mounting hole 30 in the center of the anchor plate 12. The second end 34 of the tensioning tether 14 is disposed in the void space 38 between the joists 36. The brackets 40 are installed on the opposing joists 36 at points that overlap the reach of the tensioning tether 14. The length of beam 46 is then set in place to determine where the tensioning tether 14 would intersect the length of beam 46. This position is typically near the center of the length of beam 46, but the position can vary due to obstacles, such as plumbing and/or wires. Once the intersection point is determined, a hole 50 is drilled through the length of beam 46 to accommodate the passage of the tensioning tether 14 through the length of beam 46. If the tensioning tether 14 is a helical tie or helical rod, the tensioning tether 14 can be directly driven through the length of beam 46.

Once the tensioning tether 14 is advanced through the length of beam 46, a nut and washer set 54 are then used to tighten the tensioning tether 14 against the length of beam 46. As the tensioning tether 14 tightens, the anchor plate 12 is biased against the masonry wall 18. Any excess tensioning tether 14 that extends beyond the length of beam 46 can be trimmed.

Figure 4:
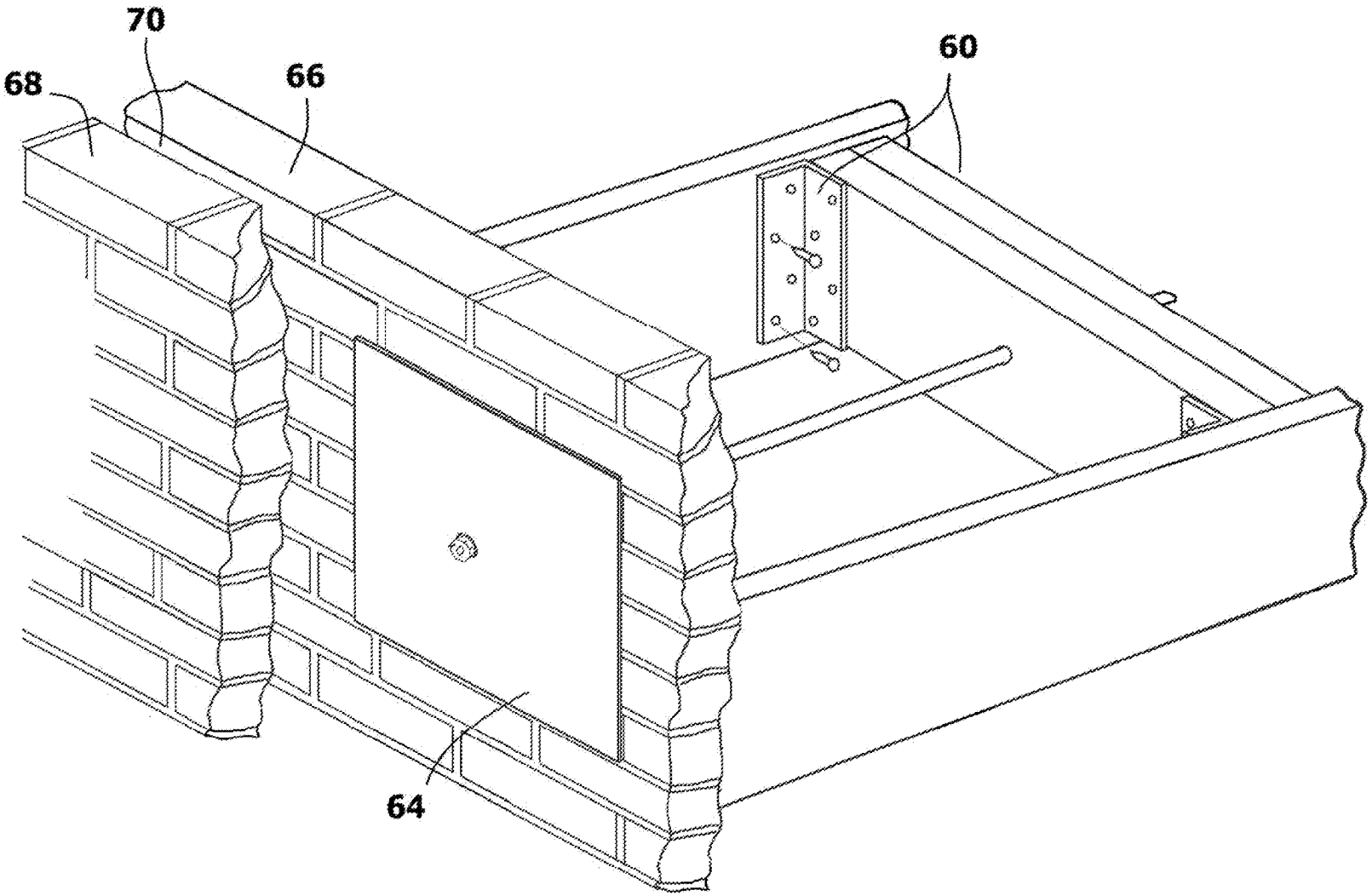
FIG. 4 is a fragmented view of a two-course wall in a building in which an alternate embodiment of the reinforcement system is installed.

Referring to FIG. 4, an alternate embodiment of the reinforcement system 60 is shown. In this embodiment, the masonry wall 62 has two courses of brick that are interlocked with joining bricks. Such wall construction was commonplace from the mid-1800's to the mid-1900's. In the shown system, a plain anchor plate 64 is utilized because the presence of the anchor plate 64 is being hidden. The anchor plate 64 is a simple plate of steel or stainless steel. If steel, the anchor plate 64 is treated or painted to be resistant to rust.

The anchor plate 64 is placed in a gap 66 between the first course of brick 68 and second course of brick 70. This is accomplished by creating an opening in the first course of brick 68, inserting the anchor plate 64 and tensioning tether 14. The opening in the first course of brick 70 is then repaired. The tensioning tether 14 and the anchoring system 16 are the same as has been previously described. Thus, the wall is reinforced without the anchor plate 64 being visible.

It will be understood that the embodiments of the present invention that are illustrated and described are merely exemplary and that a person skilled in the art can make many variations to those embodiments. For instance, the size, thickness and length of the anchor plates and tensioning tethers can be varied to meet the needs and aesthetics of a particular building. All such embodiments are intended to be included within the scope of the present invention as defined by the claims.

What is claimed is:

1. In a building having a masonry wall with an exterior surface and at least one floor supported with floor joists, a method of retroactively reinforcing said masonry wall from within a void space in between said floor joists, said method comprising the steps of:

providing a first bracket, a second bracket and a beam;

anchoring said first bracket to a first joist of said floor joists;

anchoring said second bracket to a second joist of said floor joists;

mounting said beam across said void space to said first bracket and to said second bracket;

providing an anchor plate having a face surface, an opposite contact surface and a geometric center, wherein a mounting hole extends through said anchor plate from said face surface to said contact surface at said geometric center of said anchor plate;

advancing a tensioning tether through said masonry wall;

positioning said contact surface of said anchor plate against said masonry wall, wherein said tensioning tether extends through said mounting hole in said anchor plate;

anchoring the tensioning tether to said beam; and tensioning and anchoring said tensioning tether to said anchor plate to bias said anchor plate against the masonry wall.

2. The method according to claim 1, wherein providing a beam includes providing a beam made from multiple pieces of cut lumber.

3. The method according to claim 1, wherein providing a first bracket and a second bracket includes providing two lengths of angle iron.

4. The method according to claim 1, wherein said masonry wall is the inner course of a two course brick wall.

5. The method according to claim 4, further including creating an opening in said two course brick wall and installing said anchor plate against said inner course within said two course wall.

6. The method according to claim 1, wherein said tensioning tether has a threaded end, and wherein tensioning and anchoring said tensioning tether includes threading a nut onto said threaded end that tightens on said tensioning tether and biases said anchor plate against said masonry wall.

7. The method according to claim 1, wherein advancing a tensioning tether through said masonry wall includes drilling a hole through said masonry wall for said tension tether to pass.

8. The method according to claim 1, wherein advancing a tensioning tether through said masonry wall includes directly driving said tensioning tether through said masonry wall.

9. The method according to claim 1, wherein said tensioning tether is selected from a group consisting of a helical masonry tie, steel bolt, rod, chain, and a cable.

* * * * *